United States Patent [19]

Fish

[11] Patent Number: 4,883,503

[45] Date of Patent: Nov. 28, 1989

[54] ACCESS FLOOR CONSTRUCTION

[75] Inventor: Hugh R. A. Fish, London, Great Britain

[73] Assignee: Microfloor Systems Limited, London, England

[21] Appl. No.: 116,099

[22] Filed: Nov. 2, 1987

[51] Int. Cl.[4] ..... E04B 5/48

[52] U.S. Cl. ..... 52/220; 52/105; 52/263

[58] Field of Search ..... 52/263, 260, 480, 105, 52/127.1, 387, 475; 33/526, 527

[56] References Cited

U.S. PATENT DOCUMENTS

| | | | |
|---|---|---|---|
| 1,861,359 | 5/1932 | Pyron | 52/387 |
| 2,867,301 | 1/1959 | Benton . | |
| 3,387,422 | 6/1968 | Wauzer | 52/387 |
| 3,852,928 | 12/1974 | Raith | 52/263 |
| 4,026,083 | 5/1977 | Hoyt et al. | 52/387 |
| 4,558,544 | 12/1985 | Albrecht et al. | 52/263 X |
| 4,573,302 | 3/1986 | Curetto | 52/105 X |
| 4,648,592 | 3/1987 | Harinishi | 52/480 X |
| 4,662,140 | 5/1987 | Porter et al. | 52/387 X |
| 4,761,926 | 8/1988 | Rea et al. | 52/387 |

FOREIGN PATENT DOCUMENTS

| | | | |
|---|---|---|---|
| 1196345 | 7/1965 | Fed. Rep. of Germany . | |
| 2314463 | 2/1975 | Fed. Rep. of Germany . | |
| 3415581 | 11/1985 | Fed. Rep. of Germany . | |
| 1547666 | 10/1967 | France . | |
| 1601001 | 9/1970 | France . | |
| 2041599 | 1/1971 | France . | |
| 822738 | 10/1959 | United Kingdom | 52/263 |
| 1425977 | 2/1976 | United Kingdom . | |
| 2097836 | 5/1981 | United Kingdom . | |

*Primary Examiner*—Carl D. Friedman

*Attorney, Agent, or Firm*—Biebel, French & Nauman

[57] ABSTRACT

A raised access floor construction comprises floor panels supported above a subfloor on spaced pedestal blocks upstanding from the subfloor. The pedestal blocks are maintained in predetermined positions by a base layer of thin sheeting material laid on the subfloor and having an array of pedestal block locating means formed on its upper surface in the predetermined positions and with which the pedestal blocks are engaged.

18 Claims, 3 Drawing Sheets

ACCESS FLOOR CONSTRUCTION

BACKGROUND OF THE INVENTION

The present invention relates to an elevated or raised access floor construction which can be erected on an existing floor to provide underfloor space for the accommodation of electrical and other services and for the distribution of such services to any position beneath the floor.

Current methods of constructing raised access floors have concentrated on systemised constructions, using a series of equally spaced metal pedestals which support raised flooring assembled from rectangular panels of timber or metal. The pedestals only have a shaft diameter of some 2–3 mm and are permanently fastened down with screws or glue in exact positions onto the subfloor, that is, the existing floor. They have flattened and/or shaped tops upon which the corners of the raised floor panels must fit exactly. Spacing of the pedestals is at some 500–600 mm centres to suit the corners of the floor panels, which have exactly matching dimensions. The floor panels can be lifted to provide the required access. Another current system uses timber batons and timber floor panels to provide an underfloor service space, but such systems do not allow easy removal of the flooring and access to the service space.

SUMMARY OF THE INVENTION

It is an object of the present invention to provide a novel construction of raised access flooring which is easy to install and which permits full and easy access to the resulting underfloor space.

The invention consists in an access floor construction in which floor panels are supported above a subfloor on spaced pedestals upstanding from the subfloor, characterised by a base layer of sheeting material disposed on the subfloor and having an array of pedestal block locating means formed on the upper surface thereof for retaining pedestal blocks in predetermined positions, and pedestal blocks disposed in engagement with said block locating means and supporting the floor panels.

Since the amount of underfloor space required for wiring, pipework and other services never approaches that available when thin pedestals are used to support a raised access floor, with the present invention the supporting blocks may not only be large and squat in comparison, but they can be disposed at much closer centres so that the load bearing floor panels do not have to span so far and can therefore be thinner in construction. Moreover, since the pedestal blocks may have a much larger bearing area than is available from the tops of the hitherto used pedestals, they do not have to be so accurately positioned. Indeed, they do not have to be fastened to the base layer but may simply sit on the latter and are retained in the required lateral positions by the associated block locating means.

The invention also consists in a base sheet for use in constructing a raised access floor, characterised in that the base sheet is adapted to be disposed on a subfloor for locating pedestal blocks for the access floor, and in that the sheet has an array of pedestal block locating means formed on one surface for retaining the pedestal blocks in predetermined positions with respect to the sheet.

The invention further consists in a kit of parts for constructing a raised access floor which comprise floor panels supported above a subfloor on spaced pedestals upstanding from the subfloor, characterised by a plurality of base sheets for laying on the subfloor and each having an array of pedestal block locating means formed on its upper surface for retaining pedestal blocks in predetermined positions, and a plurality of pedestal blocks for engaging with the block locating means and supporting the floor panels.

The block locating means on the base layer and, hence, the pedestal blocks are conveniently arranged in a regular array so that the raised access floor provides a grid of continuous rectilinear underfloor passages or ducts crossing one another at right angles.

The block locating means may comprise protuberances embossed on the upper surface of the base layer and engaging the outsides on the pedestal blocks to retain the blocks in the predetermined positions. Alternatively, the block locating means may comprise openings in the base layer of substantially complementary shape to the plan of the pedestal blocks and having protuberances embossed on the upper surface of the base layer about the peripheries of the openings and engaging the outsides of the pedestal blocks to retain the blocks in the predetermined positions. In either event, the protuberances of each block locating means form firm abutments or shoulders for the sides of the blocks to stabilise and positively retain the blocks in their predetermined positions. The protuberances constituting the block locating means may be arranged so as generally to define receptacles of similar shape to the plan of the blocks and within which the blocks are seated.

The base layer may be assembled from a plurality of individual sheets, each of which has an array of block locating means on its upper surface. The sheets may be suitably interconnected at mutually adjacent edges. For example, they may be clipped together in abutting or overlapping relation. In a preferred embodiment, the sheets are arranged with overlapping margins and have embossed hollow studs at their mutually overlapping margins which interengage to connect the sheets together in precisely located relationship.

Preferably, the sheets, including block locating means and interconnecting studs, are moulded form thin plastics sheet material, such as, by thermoforming. Such sheets are flexible and can accommodate the contours of an uneven subfloor and can easily be cut with a knife to fit any shaped room.

The pedestal blocks may be of square or other rectangular shape in plan or may be circular. Conveniently, they are lightweight concrete blocks, for example, aerated autoclaved concrete blocks. Alternatively, they may be standard bricks, preferably, lightweight bricks. However, they may also be made of any other suitable rigid material, such as, timber of metal.

To accommodate large differences in subfloor levels, the pedestal block may be produced in a range of different heights, for example, in 5 mm increments. Fine levelling may be achieved by the use of shims placed under the blocks for precisely adjusting their heights and, hence, the support for the floor panels. Alternatively, or in addition, the tops of the pedestal blocks may be fitted with caps which are capable of retaining shims between the tops of the blocks and the caps for adjusting the level of the caps.

The floor panels may be fabricated from conventional floor decking, such as, plywood, chipboard or metal sheeting. However, preferably, they are formed from dense particle board which may, if required, be clad on one side or be totally encased in metal sheeting.

The invention provides a lightweight robust access floor construction which may be readily installed in either new or older buildings on an existing, structural subfloor. It requires no remedial work to an uneven subfloor and, because of its lightweight construction, needs no additional reinforcement to the existing structure. It may be used in buildings where there is a restricted floor-to-ceiling space, which cannot be reduced, but where the addition of a small underfloor space for services may be very valuable.

BRIEF DESCRIPTION OF THE DRAWINGS

In order that the present invention may be more readily understood, reference will now be made to the accompanying drawings, in which.

DESCRIPTION OF THE PREFERRED EMBODIMENTS

Figure 1:
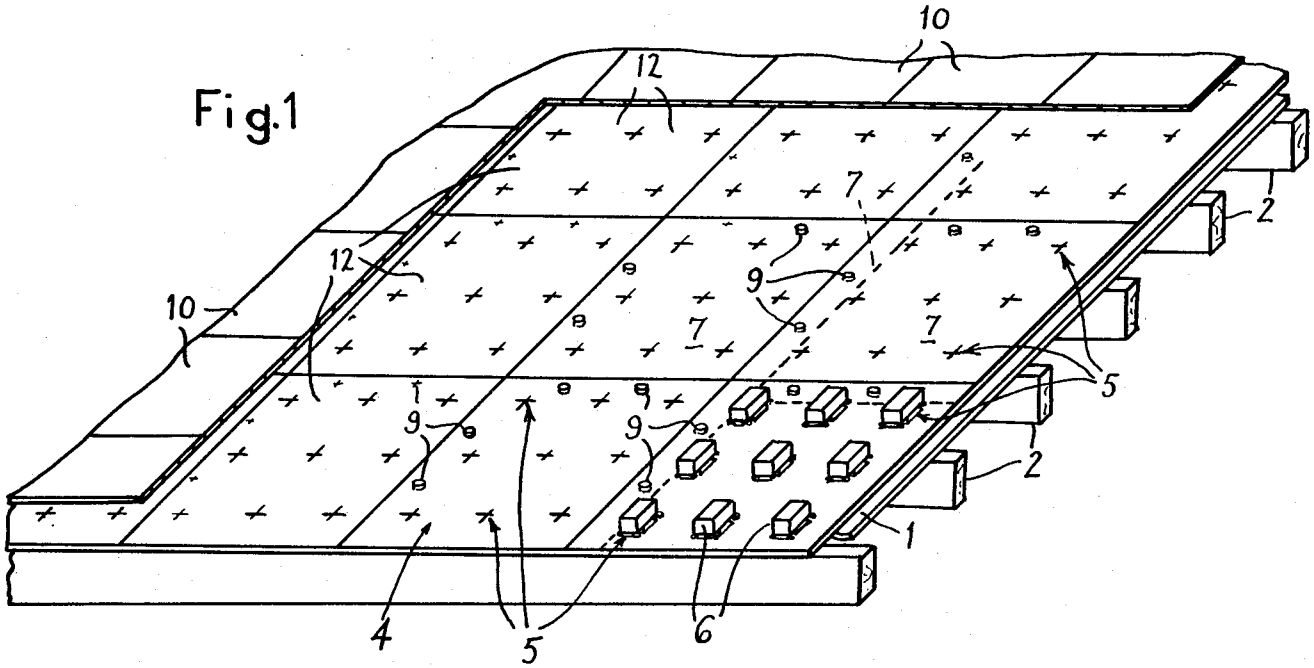
FIG. 1 is a perspective view illustrating one embodiment of the invention, with some of the floor panels of the access floor removed.
Figure 3:
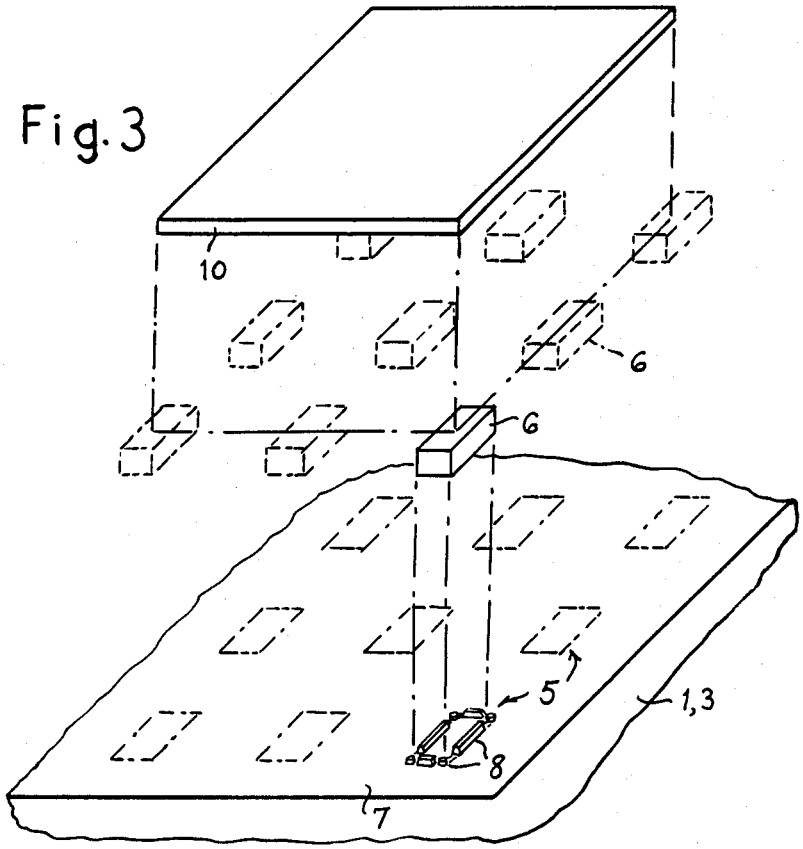
FIG. 3 is an exploded view of the construction illustrated in FIG. 2.
Figure 2:
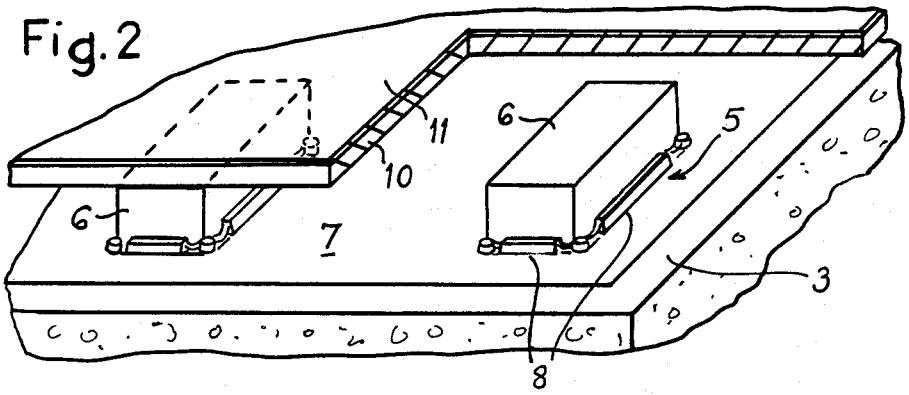
FIG. 2 is an enlarged fragmentary view of the access floor construction of FIG. 1 and also illustrates a different subfloor structure.

Referring to FIGS. 1, 2 and 3 of the drawings, the access floor according to the invention may be erected on any type of existing subfloor structure, such as, a timber floor 1 supported by timber joists 2, as illustrated in FIG. 1, or a reinforced concrete floor 3, as illustrated in FIG. 2. It comprises a base layer 4 of sheeting material laid on the subfloor 1,3 and having a regular array of block locating means 5 disposed on its upper surface for locating pedestal blocks 6 and consisting of mutually perpendicular rows and columns of rectangular block locating receptacles. The sheeting layer is assembled from a plurality of identical, thin, rectangular, moulded plastic sheets 7 having the block locating receptacles moulded on their upper surfaces. For example, these sheets may be vacuum formed from polyvinyl chloride sheet material with the receptacles 5 being defined by moulded hollow protuberances 8 embossed on the upper surface of the sheet and defining receptacles of complementary shape to the plan of the pedestal blocks 6. The individual sheets 7 may, for example, be 0.5 mm thick and 1 meter square with the block locating receptacles being disposed on either 250 mm or 300 mm centres. The sheets 7 are assembled on the subfloor 1,3 with mutually overlapping margins and are interconnected by moulded hollow studs 9 along the margins of one sheet interengaged with identical hollow studs along the plastics sheets forming the base sheeting layer 4 may be easily cut in situ, to fit the shape of a room in which the access floor is installed.

The pedestal blocks 6 are made from large standard-size lightweight concrete blocks and cut to size. The receptacles 5 are of substantially complementary shape to the plan of the blocks 6. The latter are seated in the receptacles and the protuberances 8 defining the receptacles form firm abutments against the faces of the blocks in order to retain the blocks in the predetermined lateral positions defined by the receptacles.

Supported on the pedestal blocks 6 are load-bearing floor panels 10 which may be made from dense particle board clad on its upper side with steel sheeting 11. These panels are made to a size, for example 500 mm square, so as to rest on several pedestal blocks with their corners resting on four blocks (see FIG. 3). The flooring formed from the floor panels may be finished with carpet tiles (not shown).

The raised access floor construction described above provides a grid of rectilinear underfloor passages or ducts 12 crossing at right below the flooring panels 10 for accommodating electrical and other services. One use of such an access floor is in office buildings where there is no provision for underfloor services and where the multitude of overfloor wires from office computers, typewriters, etc, causes risk and inconvenience to personnel. In such a situation, the access floor is constructed as follows. The existing carpets and underfelting are removed, and sheets 7 are laid on the subfloor in overlapping relation and are interconnected by the moulded studs 9 to assemble the base sheeting layer 4 which may be cut, where required, to lie up to the skirting boards of the room. The pedestal blocks 6 are then disposed in their locating receptacles 5 and shims (not shown) may be placed under the blocks to adjust their height and achieve fine levelling for support of the floor panels 10. The existing wiring is laid in the spaces 12 between the pedestal blocks, whereafter the flooring panels 10 are laid across the tops of the blocks. Where wires or other services are to enter and leave the access floor, suitable openings fitted with service outlets may be provided in the floor panels 10. Otherwise, the flooring is fitted with carpet tiles on some grid appropriate to that of the floor panels.

Should additional services or changes to the existing services be required after completion, simple removal of the carpet tiles and the appropriate panel or panels 10 gives access to the underfloor cavities 12 and this removal is only along the proposed service run without disruption to other areas. Refitting of the floor panels 10 and carpet tiles is then accomplished very easily and the whole operation can be performed without the need for specialist tradesmen.

Figure 4:
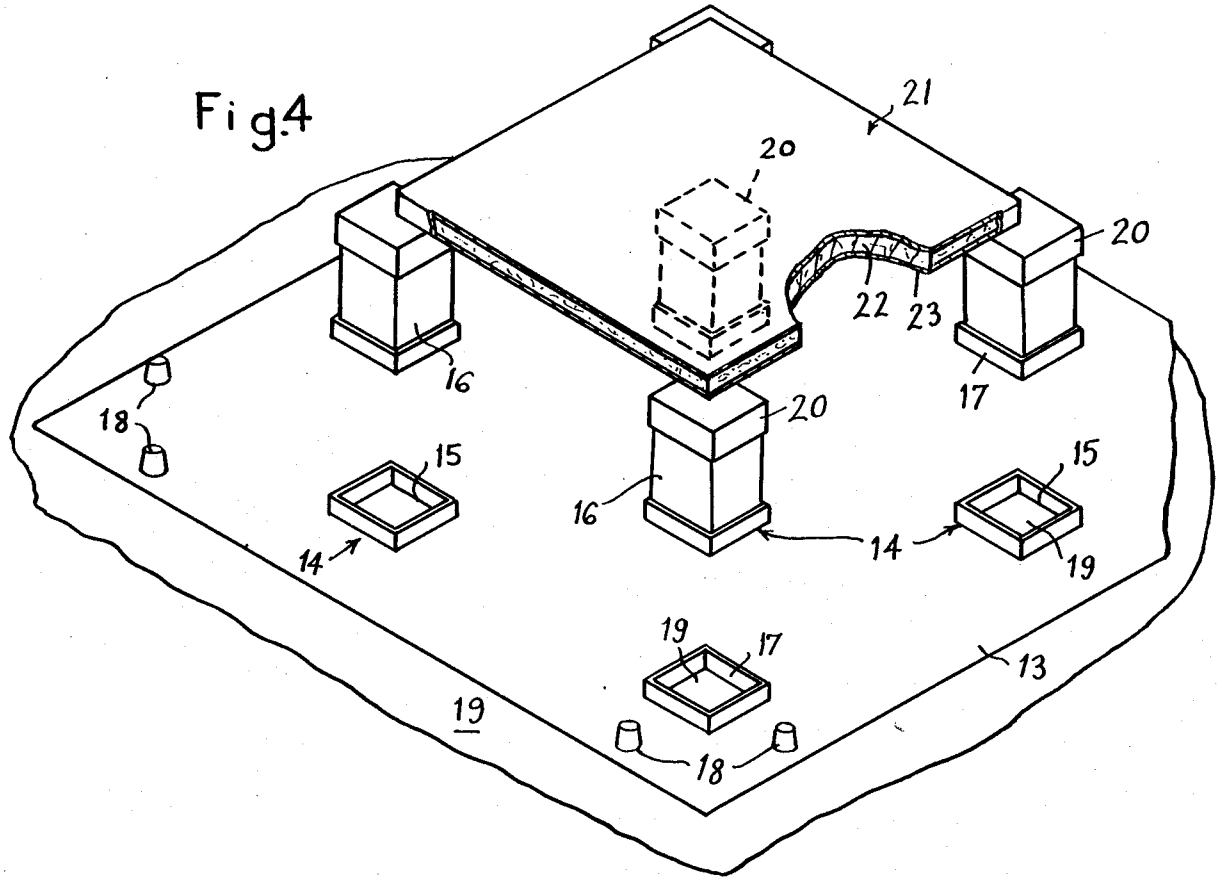
FIG. 4 is a perspective view illustrating another embodiment of the invention.

In the embodiment illustrated in FIG. 4, each base sheet 13 is vacuum formed from thin plastics sheet material and incorporates a regular staggered array of pedestal block locating means 14 comprising rectangular openings 15 in the sheet of complementary shape to the plan of the pedestal blocks 16 to be positioned thereby, and surrounded by hollow peripheral ridges 17 embossed on the upper surfaces of the sheet. Hollow studs 18 are formed adjacent each corner of the sheet to permit the sheet to be connected to adjacent sheets 13 in overlapping relationship. When so disposed, the hollow studs 18 of one sheet fit into the cavities of the studs of a superimposed sheet to make the connection.

The pedestal blocks 16, preferably formed from lightweight concrete, are seated in each opening 15 and rest on the subfloor 19. The peripheral ridges 17 of the receptacles engage the sides of the blocks and prevent them from moving laterally from the predetermined positions established by the receptacles. The tops of the blocks 16 are fitted with caps 20 and shims (not shown) may be placed in the bottoms of the receptacles, under the blocks, and/or between the tops of the blocks and the underneath of the caps 20 in order to adjust the heights of the blocks and achieve fine levelling for the support of the floor panels 21.

The floor panels 21 comprise dense particle board totally encased in metal sheeting 23, such as, steel sheeting. The arrangement is such that each floor panel is supported by five pedestal blocks 16, that is, one at each corner and one in the centre of the panel.

In one practical form of the embodiment illustrated in FIG. 4, the base sheets 13 are 2 m square and 0.5 mm thick, the receptacles 14 are disposed on 300 mm centres in a staggered arrangement with 30 mm high ridges 17, the floor panels 21 are 600 mm square, and the blocks are 113×115×200 mm high.

Whilst particular embodiments have been described, it will be understood that modifications can be made without departing from the scope of the invention, as defined by the appended claims. For example, if necessary, locating pins, lugs or other projections may be provided on the undersides of the floor panels 10,21 to prevent them sliding with respect to the blocks 6,16.

I claim:

1. In an access floor construction in which floor panels are supported above a subfloor on spaced pedestals upstanding from said subfloor, said floor panels being individually removable to provide ready access to underfloor space between said floor panels and said subfloor, the improvement comprising blocks forming said pedestals, and a base layer of sheeting material disposed on said subfloor and having an array of pedestal block locating means on an upper surface thereof adapted to retain said pedestal blocks in predetermined positions, said pedestal blocks being disposed in engagement with said block locating means and supporting said floor panels.

2. An access floor construction according to claim 1, wherein the block locating means are arranged on the base layer in a regular array, whereby the access floor has a grid of rectilinear underfloor passages.

3. An access floor construction according to claim 1, wherein the block locating means comprise protuberances disposed on the upper surface of the base layer and engaging the outsides of the pedestal blocks to retain the blocks in the predetermined positions.

4. An access floor construction according to claim 3, wherein the pedestal blocks are of rectangular plan and block locating protuberances define receptacles of substantially complementary shape in plan.

5. An access floor construction according to claim 3, including at least one shim disposed in the bottom of at least one of the pedestal block locating means for adjusting the height of the pedestal blocks.

6. An access floor constructions according to claim 1, wherein the block locating means comprises openings in the base layer of substantially complementary shape to the plan of the pedestal blocks and having protuberances disposed on the upper surface of the base layer about the peripheries of the openings and engaging the outsides of the pedestal blocks to retain the blocks in the predetermined positions.

7. An access floor construction according to claim 1, including caps disposed on the tops of the pedestal blocks, said caps being capable of retaining shims between the tops of the blocks and the caps for adjusting the level of the caps and, hence, the support for the floor panels.

8. An access floor construction according to claim 1, wherein said base layer is assembled from a plurality of individual sheets, each of which has an array of said pedestal block locating means, said sheets being interconnected at mutually adjacent edges.

9. An access floor construction according to claim 8, wherein said sheets are arranged with mutually overlapping margins and include interengaging means at said overlapping margins which interconnect said sheets.

10. A base sheet used in constructing a raised access floor which comprises individually removable floor panels supported above a subfloor on spaced pedestals defined by blocks located by said base sheet, said base sheet being adapted to be disposed on said subfloor to locate said pedestal blocks for said access floor with respect to said subfloor, and including an array of pedestal block locating means formed on one surface thereof and adapted to engage sides of individual ones of said pedestal blocks to retain said pedestal blocks in predetermined positions with respect to said sheet.

11. A kit of parts used in constructing a raised access floor which comprises floor panels supported above a subfloor on spaced pedestals upstanding from said subfloor, said floor panels being individually removable to provide ready access to underfloor space between said floor panels and said subfloor, comprising a plurality of blocks for forming said pedestals, and a plurality of base sheets for laying on said subfloor and each having an array of pedestal block locating means adapted to engage sides of individual ones of said pedestal blocks to retain said pedestal blocks in predetermined positions with respect to an upper surface of said sheet, said pedestal blocks being engageable with said block locating means for supporting said floor panels.

12. An access floor construction in which floor panels are supported above a subfloor on spaced pedestals upstanding from said subfloor, said floor panels being individually removable to provide ready access to underfloor space between said floor panels and said subfloor said access floor construction comprising blocks forming said pedestals, and a base layer of sheeting material disposed on said subfloor and having pedestal block locating means formed on an upper surface of said base layer in a regular array and adapted to retain said pedestal blocks in predetermined positions relatively to said subfloor, said block locating means comprising protruberances disposed on said upper surface of said base layer for engaging the outsides of said pedestal blocks to retain said blocks in said predetermined positions, and said pedestal blocks being disposed in engagement with said blocks locating means and supporting said floor panels.

13. A access floor construction according to claim 12, wherein said block locating means includes openings in said base layer of substantially complementary shape to the plan of said pedestal blocks, said protruberances being disposed on said upper surface of said base layer about the peripheries of said openings for engaging the outsides of pedestal blocks disposed in said openings to retain said blocks in said predetermined positions.

14. An access floor construction according to claim 12, wherein said pedestal blocks are of rectangular plan and said block locating protruberances define receptacles of substantially complementary shape in plan.

15. An access floor construction according to claim 12, including at least one shim disposed beneath at least one of said pedestal blocks for adjusting the height thereof.

16. An access floor construction according to claim 12, including caps disposed on the tops of said pedestal blocks, said caps being capable of retaining shims between said tops of said blocks and said caps for adjusting the level of said caps and, h ence, the support for said floor panels.

17. An access floor construction according to claim 12, wherein said base layer is assembled from a plurality of individual sheets, each of said sheets having an array of block locating means, and said sheets being interconnected at mutually adjacent edges.

18. An access floor construction according to claim 17, wherein said sheets are arranged with mutually overlapping margins and include interengaging means at said overlapping margins which interconnect said sheets.

* * * * *